US006570960B1

(12) United States Patent
Kuzniar et al.

(10) Patent No.: US 6,570,960 B1
(45) Date of Patent: May 27, 2003

(54) HIGH VOLTAGE ISOLATED ROTOR DRIVE FOR ROTATING ANODE X-RAY TUBE

(75) Inventors: Daniel E. Kuzniar, Lyons, IL (US); Lester D. Miller, Hudson, OH (US); Gerald J. Carlson, Lombard, IL (US)

(73) Assignee: Koninklijke Philips Electronics N.V. (NL)

( * ) Notice: Subject to any disclaimer, the term of this patent is extended or adjusted under 35 U.S.C. 154(b) by 0 days.

(21) Appl. No.: 09/519,986

(22) Filed: Mar. 7, 2000

(51) Int. Cl.[7] ..... H01J 35/10
(52) U.S. Cl. ..... 378/125; 378/121; 378/131
(58) Field of Search ..... 378/121, 125, 378/130, 131, 132, 143, 144

(56) References Cited

U.S. PATENT DOCUMENTS 3,619,696 A * 11/1971 De Lucia ..... 378/131
4,188,559 A 2/1980 Carville et al.
4,608,707 A * 8/1986 Gabbay et al. ..... 378/132
4,622,687 A * 11/1986 Whitaker et al. ..... 378/130
4,780,900 A * 10/1988 Gabbay et al. ..... 378/123
5,274,690 A 12/1993 Burke et al.
5,581,591 A 12/1996 Burke et al.
5,995,584 A * 11/1999 Bhatt ..... 378/125

* cited by examiner

*Primary Examiner*—Robert H. Kim
*Assistant Examiner*—Therese Barber
(74) *Attorney, Agent, or Firm*—Eugene E. Clair

(57) ABSTRACT

An x-ray tube (20) includes an evacuated envelope (26). Mounted within the evacuated envelope are a cathode (23) and a rotatbly supported anode (30). A rotor (70) is included for rotatably driving the anode. The rotor (70) is electrically insulated from the anode (30) by a disk (76) comprised of an insulating material.

25 Claims, 4 Drawing Sheets

HIGH VOLTAGE ISOLATED ROTOR DRIVE FOR ROTATING ANODE X-RAY TUBE

BACKGROUND OF THE INVENTION.

The present invention relates to rotating anode x-ray tubes and is particularly related to a drive apparatus for rotating the anode within an evacuated envelope. The present invention also relates to apparatus for electrically isolating the anode from at least a portion of the rotary drive producing elements located within the evacuated envelope.

Typically, a rotating anode x-ray tube includes an evacuated envelope, a cathode assembly, a rotating anode assembly, a bearing assembly to facilitate anode rotation and an induction motor to drive rotation of the anode. The induction motor includes a stator located external the evacuated envelope and a rotor attached to the anode assembly and located within the envelope. Energizing the stator coils causes the rotor of the induction motor to rotate the anode in the bearing assembly, as more fully described below.

During production of x-rays, a current is passed through a cathode filament located in the cathode, heating the filament such that a cloud of electrons is emitted, i.e. thermionic emission occurs. A high electrical potential, on the order of 100–200 kV, is applied across the cathode assembly and the anode assembly. The high voltage potential accelerates the electrons and causes them to flow in an electron beam from the cathode assembly to the anode assembly. A cathode cup focuses the flowing electrons onto a small area, or focal spot, on a target of the anode assembly. A portion of the x-rays pass through one or more x-ray transmissive windows of the envelope and an x-ray tube housing.

During x-ray generation, substantial heat is generated by the electron beam striking the anode. In order to distribute the thermal loading created during the production of x-rays, a rotating anode assembly configuration has been adopted for many applications. In this configuration, the anode assembly is rotatably supported by the bearing assembly. As the electron beam strikes the anode, the anode is rotated in the bearing assembly by the induction motor about an axis such that the electron beam strikes a continuously rotating circular path about a peripheral edge of the rotating anode. The portion of the anode along the circular path that is being struck by the electron beam becomes heated to a very high temperature during the generation of x-rays. The rotating anode is thus cooled before returning to be struck again by the electron beam.

As described above, a high electrical potential difference is applied across the anode assembly and cathode assembly during the production of x-rays. The rotor of the induction motor attached to the anode assembly is at the same high electrical potential as the anode assembly. Raising the rotor to the anode potential presents a problem since the stator of the induction motor, located outside the x-ray tube evacuated envelope, is at a different electrical potential, usually ground. Because of the large potential difference between the stator and rotor, the stator and rotor have to be spaced apart such that arcing between the two motor sections does not occur. However, the greater the spacing between the rotor and stator, the greater the reluctance between the rotor and stator. Higher reluctance reduces the efficiency of the motor. The reduced efficiency of the motor usually results in the following disadvantages: (i) designed oversizing of the motor to meet anode rotation requirements, (ii) excess heat generation in the rotor due to eddy currents, (iii) longer time to reach operational speed of the rotating anode, (iv) decreased x-ray tube and bearing life, and (v) added cost of manufacture and operation. As the need for higher power x-ray tubes increases, larger anodes used to meet those needs will further exacerbate these problems. Larger anodes, with increased moments of inertia, require more force from the induction motor to accelerate quickly to operational speeds.

Some of the disadvantages listed above are interrelated, for example, slower acceleration of the anode induces more heat in the rotor of the x-ray tube. The rotor heat, in addition to the heat transferred from the anode during normal operation, can migrate to the bearings which can result in reduced lubricant efficiency due to evaporation of the lead and silver ball bearing lubricant. Reduced lubricant efficiency is detrimental to tube and bearing life.

As the anode accelerates to operational speed, it passes rotational speeds that create major mechanical resonances in the rotating components of the tube. Less efficient motors, having slower acceleration of the anode to operational speed, increases the amount of time that the anode experiences these major mechanical resonances. This factor also increases mechanical wear of the bearings and has an undesirable effect on tube and bearing life.

SUMMARY OF THE INVENTION

The present invention is directed to an x-ray tube that satisfies the need to provide a rotating anode x-ray tube which has improved motor efficiency. The present invention also provides for alternate drive apparatus configuration for rotating the anode. An apparatus in accordance with one embodiment of the present invention includes an x-ray tube having an evacuated envelope. Inside the evacuated envelope are a cathode and a rotatably mounted anode. The apparatus includes a rotor for rotatably driving the anode. The rotor is electrically insulated from the anode by mounting the rotor to the anode assembly using an electrically insulating member.

In accordance with a more limited aspect of the present invention, the apparatus includes a stem attached to the rotatably mounted anode and the stem is rotatably supported in the evacuated envelop by at least one bearing. The bearing has an outer bearing race member. The evacuated envelope of the x-ray tube includes a cylindrical wall portion and the outer bearing race member of the bearing is received along an inner surface of the cylindrical wall portion.

In accordance with another limited aspect of the present invention, the electrically insulating member is a ceramic material, preferably Alumina.

In yet another limited aspect of the present invention, the rotor is a disk configuration.

In accordance with a more limited aspect of the invention, the rotor includes permanent magnets.

In accordance with another aspect of the present invention, the apparatus includes a drive member external to the tube, the drive member including means for providing a magnetic field coupled to the rotor.

In accordance with another aspect of the present invention the external drive member includes any of a fluid drive, a gear drive, a belt drive, a DC motor, or a pancake wound stator.

In accordance with another aspect of the invention, a method is provided for rotating an anode supported by a bearing assembly and attached to an internal rotatary drive member. The bearing assembly and internal rotating drive member are located in an evacuated x-ray tube envelope.

The method comprising the steps of electrically insulating the internal rotatary drive member from the anode. A magnetic field of the internal rotatary drive member is magnetically coupled to a magnetic field of an external drive member. Finally, the step of rotating the magnetic field of the external drive member is implemented to rotate the anode.

In accordance with a more limited aspect of the method, the step of magnetically coupling includes the step of utilizing permanent magnets on at least one of the internal and external drive member.

In accordance with yet another limited aspect of the inventive method, the step of magnetically coupling includes the step of utilizing stator windings in the external drive member.

In accordance with another limited aspect of the inventive method, the step of rotating the magnetic field of the external drive member includes generating a magnetic field in a stator winding located outside the x-ray tube envelope.

According to yet another limited aspect of the method, the step of magnetically coupling includes the step of inducing the magnetic field of the internal drive member.

And, in another limited aspect of the invention, the step of rotating the magnetic field of the external drive member includes the step of pumping a fluid through a fluid drive device.

One advantage of the present invention is that by electrically isolating the rotor from anode potential, the stator and rotor can be closer without arcing. Closer spacing between the stator and rotor reduces reluctance and thereby improves motor efficiency. A more efficient motor allows quicker anode acceleration to operating speeds. Faster acceleration to operating speeds allows the anode to pass through major resonances thereby reducing mechanical wear to the bearings. This also reduces electromagnetically induced heating effects in the rotor.

Another advantage of the present invention is more effective cooling of the rotor bearing assembly. By moving the stator and rotor away from the bearings the bearings may be in direct contact with the tube envelope, thereby conductively cooled by the oil within the housing. In addition, removing the rotor from around bearing assembly removes this heating source from contact with the bearing assembly.

Another advantage of the present invention is that larger bearings may be used in the bearing assembly since the rotor drive components are not surrounding the bearing assembly within the neck of the x-ray tube. Larger bearings can more effectively handle the larger mechanical loads that accompany larger anodes and faster gantry rotational speeds. This increases the life of the x-ray tube.

Yet a further advantage of the present invention is that the rotor may be driven by alternate drive methods such as a pancake stator, permanent magnet or fluid drive mechanisms.

The present invention provides the foregoing and other features hereinafter described and particularly pointed out in the claims. The following description and accompanying drawings set forth certain illustrative embodiments of the invention. It is to be appreciated that different embodiments of the invention may take form in various components and arrangements of components. These described embodiments are indicative of but a few of the various ways in which the principles of the invention may be employed. The drawings are only for the purpose of illustrating a preferred embodiment and some alternate embodiments. The drawings are not to be construed as limiting the invention.

BRIEF DESCRIPTION OF THE DRAWINGS

The foregoing and other features and advantages of the present invention will become apparent to those skilled in the art to which the present invention relates upon consideration of the following detailed description of a preferred embodiment of the invention with reference to the accompanying drawings, wherein.

DETAILED DESCRIPTION

In the present invention, a new and different design and arrangement of rotary drive components in an x-ray tube provides for more efficient rotation of an anode. In particular, anode rotary drive components located inside the x-ray tube are electrically, and/or thermally, isolated and/or insulated from the high voltage and heat of the anode. Isolating the internal rotary drive components from the high anode potential permits locating the internal rotary drive components closer to the tube envelope and the associated external rotary drive components. When the internal and external rotary drive components are located closer to one another, the induction motor has improved coupling of the magnetic fields that provide force to rotate the anode. Improved magnetic coupling results in the anode being rotated more efficiently. A more efficient motor will allow quicker acceleration, smaller motor sizes to perform the same effect, cooler operation and less electrical losses.

Locating the internal and external rotary drive components closer to each other is not possible in many prior art x-ray tubes. This is because the large potential difference between the internal and external rotary drive components results in electrical arcing. Arcing can even occur with the x-ray tube envelope located between the internal and external rotary drive components.

Figure 1:
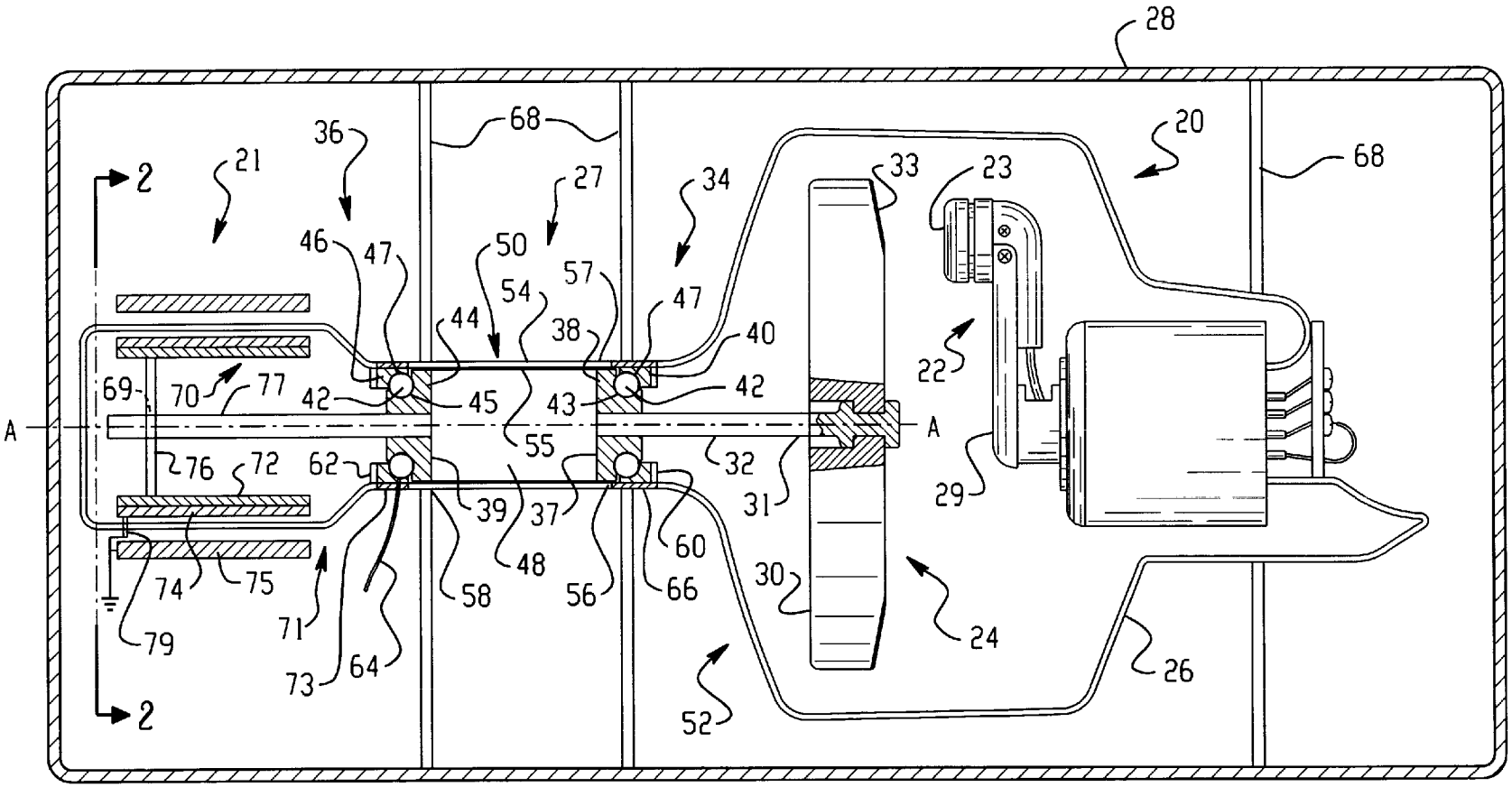
FIG. 1 is a partial sectional schematic representation of an x-ray tube including the apparatus of the present invention.
Figure 3:
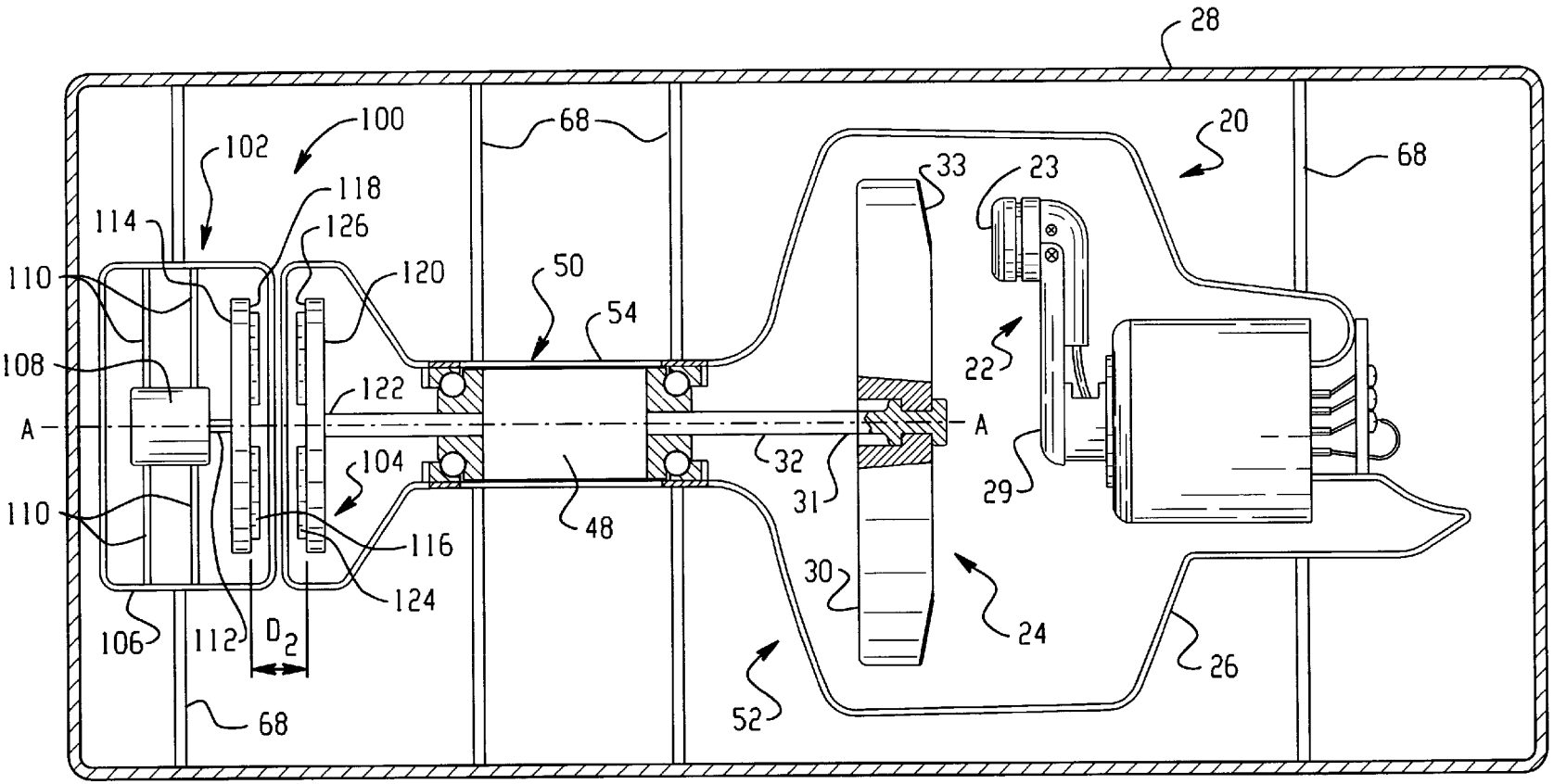
FIG. 3 is a partial sectional schematic representation of an x-ray tube including an alternate embodiment of the present invention.
Figure 4:
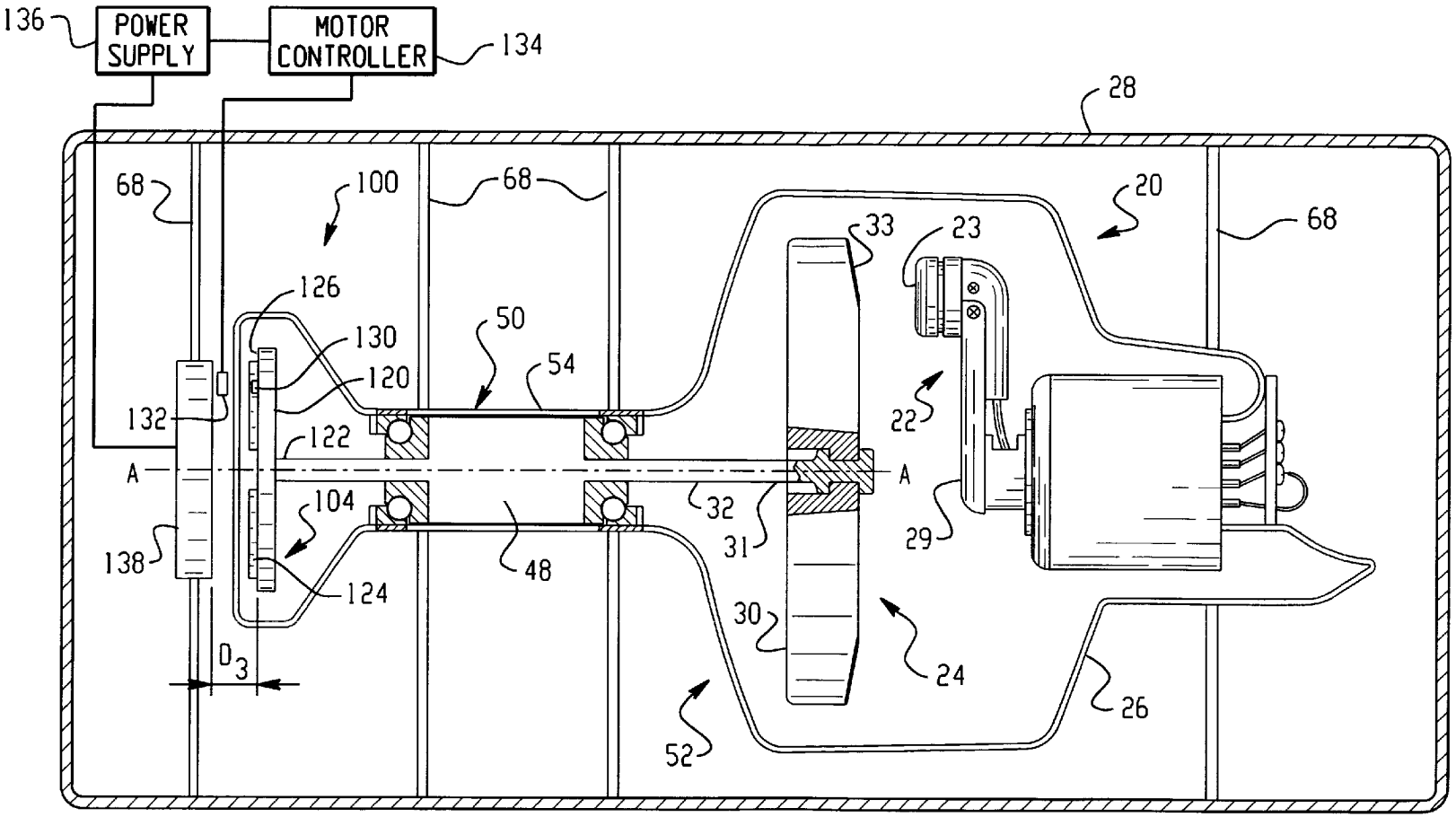
FIG. 4 is a partial sectional schematic representation of an x-ray tube including another embodiment of the present invention.

Referring to FIG. 1, an x-ray tube 20 includes a cathode assembly 22, an anode assembly 24, an evacuated envelope 26 and a bearing assembly 27. Anode rotary drive components 21 are included both inside and outside of the evacuated envelope 26. The x-ray tube 20 is enclosed within a housing 28. The housing 28 is filled with a suitable cooling medium which surrounds the tube envelope 26 to facilitate heat removal from the tube components. The housing 28 shown in FIGS. 1, 3 and 4 is a schematic representation of a structure that generally is constructed such that electrical connections to the x-ray tube are accessible via connector terminals. In addition, heat exchanger fluid connections (not shown) are provided in the housing to transport the cooling fluid to a heat exchanger (not shown) to cool the cooling medium.

The cathode assembly 22 includes a cathode 23 that has at least one cathode filament and a focusing cup. The cathode 23 is supported in the envelope 26 on a cathode support bracket 29. Electrical conductors are attached to the focusing cup and cathode filament. The conductors extend from the cathode assembly 22, through the evacuated envelope 26 and x-ray tube housing 28, to appropriate sources of electrical energy to operate each of the focusing cup and cathode filament respectively.

The anode assembly 24 includes a typical circular or annular anode disk 30 having a target portion 33 comprised of suitable material for generating x-rays. The anode disk 30 is mounted in a conventional manner to a stem 32. The stem 32 includes a shaft end 31, a central cylindrical portion 48 and a drive portion stem extension 77. The stem 32 supports the anode disk 30 at the shaft end 31. The central cylindrical portion 48 supports the stem 32 in the bearing assembly 27 for rotation about axis A—A. The drive portion stem extension 77 supports the internal components of the rotary drive, as described in greater detail below.

The stem 32 has an axis of rotation that lies generally along the line A—A. The cylindrical portion 48 of the stem 32 extends radially from the axis of rotation and has a diameter greater than the diameter of the shaft end 31 and the stem extension 77, forming a first shoulder 37 and second shoulder 39 respectively. The stem 32 or any of its component sections individually, including the shaft end 31, the cylindrical portion 48 and stem extension 77, may be solid or hollow. If the stem 32 or any of its sections are hollow, the specific thickness of the wall portion (not shown) is selected according to desired heat transfer characteristics, e.g. to reduce conduction of heat from the anode through the stem to the bearings and to the internally located rotary drive components at the stem extension 77.

The evacuated envelope 26 includes an anode housing portion 52, a neck portion 50 and a rotary drive portion 71. The anode housing portion 52 encloses the anode disk 30, a portion of the shaft end 31 of the stem 32, and the cathode assembly 22. Preferably, the anode housing portion 52 is comprised of glass, however, other suitable materials may be used such as metal or ceramic.

The neck portion 50 of the envelope 26 has a generally cylindrical wall section 54 with its major central axis extending generally along the line A—A. The cylindrical wall section 54 has an inner surface 55 and an outer surface 57. The neck 50 includes a first circular open end 56 and an opposite second circular open end 58, and serves as a portion of the bearing assembly 27, as further described in detail below. In the preferred embodiment, the material comprising the neck is selected to be thermally conductive to facilitate transfer of heat into the cooling medium. In addition, the neck material is selected to be able to withstand the mechanical loads applied to retain bearings for rotating the stem 32 with a light press fit as well as the forces that are produced during rotation of the anode in an operating medical imaging system. For example, the neck 50 is comprised of an electrically non-conducting and non-magnetic material such as the ceramic Alumina. Other ceramics such as Beryllia and the like may be used. Beryllia is desirable for its high thermal conductivity but it has high cost and is difficult to work. Alternatively, the neck portion 50 may be comprised of stainless steel or other suitable material with the desired electrically non-conducting and non-magnetic properties.

As indicated above, the neck 50 forms a component of the bearing assembly 27. The cylindrical portion 48 of the anode stem 32 and a pair of bearings 34, 36 are housed within the neck 50. The bearings 34, 36 rotatably support the anode stem 32 for rotation within the x-ray tube. The bearing 34 is located at the first end 56 of the neck 50 and has an outer race member 40 defining an outer race 41. The outer race member 40 is retained in place with a locking spring 60. The locking spring 60 is received in a retaining groove in the neck 50. The bearing 34 also includes an inner race member 38 defining an inner race 43. The inner race member 38 is attached around the shaft end 31 of the stem 32 and adjacent the first shoulder 37. A plurality of ball or other bearing members 42 are retained within the inner 41 and outer 43 races to rotatably support the stem 32.

The bearing 36 is located in the second end 58 of the neck 50 and has an inner race member 44 defining an inner race 45. An outer race member 46 defines an outer race 47. The outer race member 46 is retained with a locking spring 62. The locking spring 62 is received in a retaining groove in the neck 50. The inner race member 44 is attached around the distal stem extension 77 adjacent the second shoulder 39. A plurality of bearing members 42, similar to those in bearing 34, are retained within the inner 45 and outer 47 races to rotatably support the stem 32. Alternatively, the outer races 41, 47 can be machined directly into each or either end of the neck 50.

When the neck portion 50 is formed entirely of electrically non-conducting material it is desirable to provide an electric current path through the cylindrical wall section 54 to a generator (not shown) in order to maintain the anode assembly 24 at an appropriate electrical potential to generate x-rays. Typically, the electrical connection to the generator provides for raising the anode disk 30 to a high positive potential relative to ground or common in a bi-polar x-ray tube electrical configuration. The current may be directed through either of the bearings 34, 36 to an electrical contact or conductor 64 that extends through the cylindrical wall section 54 and is electrically connected to the generator. The electrical contact 64 may be placed at either bearing or, if desired, any other suitable location adapted to be electrically connected with the anode assembly and the generator. Alternatively, any of a roll-ring, slip-ring, wire wiper, spring loaded or other similar means can be advantageously arranged to provide the necessary electrical contact to the anode assembly and generator.

The various portions of the evacuated envelope 26 including the anode housing portion 52, the neck 50 and rotary drive housing portion 71 are joined to one another with conventional methods, depending on the composition of the material for adjacently located envelope portions. For example, the glass anode housing portion 52 joins the ceramic neck portion 50 via a transition portion 66. Preferably, the transition portion 66 is a Kovar metal band that is brazed to the first end 56 of the neck 50 and appropriately joined to the anode housing portion 52. The second end 58 of the neck 50 is suitably joined to one side of a second transition portion 73 comprised of Kovar. The drive portion 71 of the envelope 26, which is preferably comprised of glass, is joined to the other end of the second transition portion 73. The transition portions 66 and 73 are schematically represented in the Figures.

A plurality of tube supports 68 securably retain and support the x-ray tube 20 within the housing 28. The number and arrangement of the tube supports 68 shown in FIGS. 1, 3 and 4 are representative and a different, configuration, design, number and arrangement of supports may be alternatively used. The supports 68 retain the x-ray tube 20 within the housing 28 using any of a number of known methods that avoid detrimental deformation of the x-ray tube envelope at which the support is located, e.g. clamps, bosses or lightly press fit into a retaining feature in the support.

In the preferred embodiment of the present invention, the rotary drive components 21 are located at the rear of the x-ray tube, on both the inside and outside of drive portion 71. A stator 75, located outside the vacuum enclosure, extends annularly around the circumference of the drive portion 71 of the envelope 26. The internal components of the anode rotary drive include a rotor body 70. The rotor body 70 includes two adjacent co-axial cylindrical wall sections comprising a steel cylindrical wall section 72 and a copper cylindrical wall section 74. The steel cylindrical wall 72 has its outer circumferential surface attached to an inner circumferential surface of the copper cylindrical wall 74. Both wall sections 72, 74 have their major axis lying generally along axis A—A.

Figure 2A:
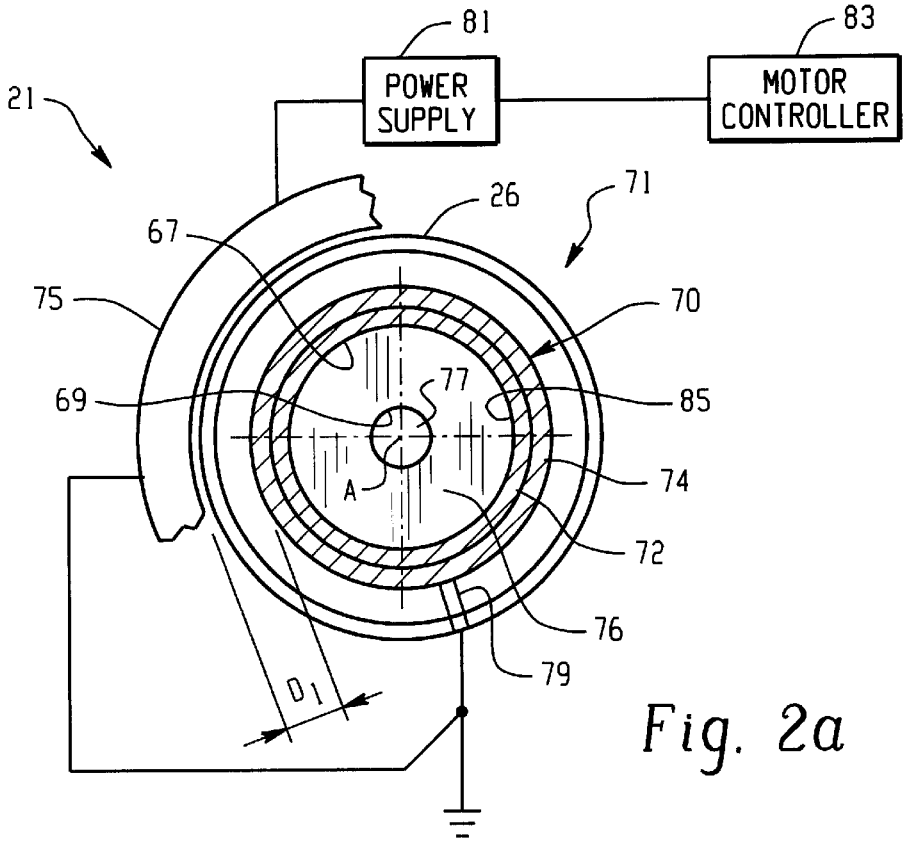
FIG. 2*a* is an end view schematic representation of the x-ray tube of FIG. 1 along line 2—2.

Referring now to FIG. 2*a*, the rotor body 70 is secured in its operating position to the drive portion of the stem 77 with an annular disk 76 comprised of a ceramic material that is an electrical insulator and may also be a thermal insulator. The disk 76 has a central bore 69 and a perimeter surface 67 located radially away from its center. The central bore 69 is securely received on the drive portion of the stem 77. An inner surface 85 of the steel cylindrical wall 72 of the rotor is attached to the perimeter surface 67 of the annular disk 76. This arrangement allows uniform rotation of the rotor body 70 around the generally central axis along the line A—A. The physical dimensions and configuration of the surfaces of the annular ceramic disk 76 are selected to provide sufficient electrical isolation and/or insulation between the high voltage on the anode stem 32 and the rotor body 70 for a particular operating voltage of the specific x-ray tube being used. It is to be appreciated that other insulating/isolating structures comprised of suitable materials may be used in place of the annular disk. For example, a frame structure having radial shafts extending from an annular member attached to the stem can also support the rotor body. The frame structure is constructed to maintain the necessary rotating requirements such as balance as well as the required electrical insulating and thermal insulating properties, if needed. In addition, portions of the stem may be comprised of insulating materials and suitably assembled to provide electrical or thermal insulation/isolation from the electrical potential and heat of the anode.

The stator 75 is operatively connected to a power supply 81, which is controllably connected to a motor controller 83. The stator 75 is energized by the power supply 81 in response to control signals from the motor controller 83.

In the present invention the ceramic disk 76 electrically insulates the rotor body 70 from the high anode potential. Thus, the rotor body 70 and the stator 75 have a potential difference that results in reducing the occurrence of damaging arcing. Since the potential difference is reduced the rotor body 70 is located more closely to the stator 75. The spacing between the stator 75 and rotor body 70 is represented by $D_1$ in FIG. 2*a*. Closer spacing of the stator 75 and rotor body 70 reduces the reluctance and improves the magnetic coupling thereby resulting in a more efficient motor. The more efficient motor can accelerate the anode to operating speeds more rapidly while generating less heat in the rotor body.

In the present invention, without a current path to shunt built up electrical charge, the rotor body 70 can gradually charge up to anode potential. To provide a current path to reduce such an accumulation of electrical charge, a conductor filament 79 is imbedded in the vacuum envelope 26 and is connected to a common connection or ground. The filament 79, placed in feedthroughs (not shown), provides a discharge path to be established thereby preventing the rotor body 70 from building up to a net positive charge. Alternatively, the following additional exemplary structures may be used to provide a suitable current path to draw electrical charge from the rotor body 70: a roll-ring, a slip-ring arranged with the rotor body 70, and a wire wiper as well as other equivalent structures that provide a current path without generating particulate matter or other contaminants inside the vacuum envelope during operation.

In addition, the bearing arrangement used in the present invention allows more efficient cooling of the bearing assembly 21 since the bearings 34, 36 are in direct thermally conductive contact with the neck portion 50. An example of such an arrangement is more fully described in co-pending application Ser. No. 09/428,795 entitled "Oil Cooled Bearing Assembly" which is incorporated herein by reference. Some of the heat in the anode is conducted from the target 30 through the stem 32 to the cylindrical stem portion 48 and subsequently to the bearings 34, 36. The conductive path for heat transfer proceeds from the bearings 34, 36 directly to the cylindrical wall section 54 and then into the cooling medium surrounding the envelope 26. More effective transfer of heat from the bearings results in extending the life of the bearings.

Figure 2B:
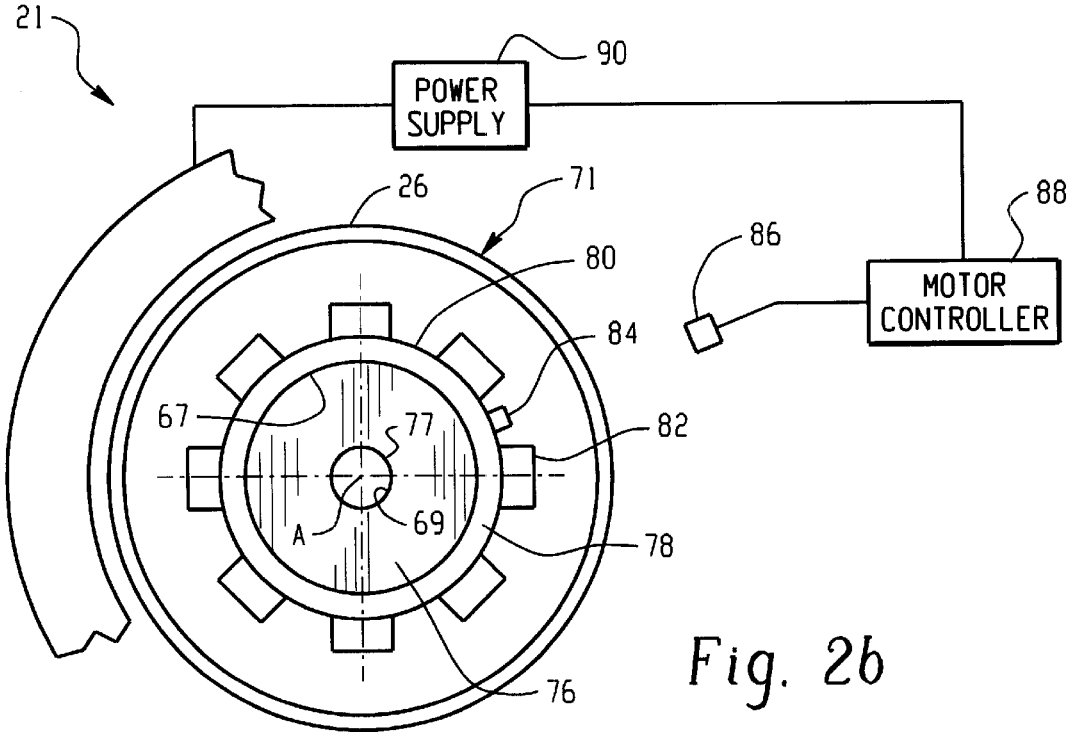
FIG. 2*b* is an end view schematic representation of an alternate embodiment of the x-ray tube of FIG. 1.

Referring now to FIG. 2*b*, another embodiment of the present invention is shown. Common elements have similar numbers as those previously described above in the preferred embodiment. The annular disk 76 is secured to the stem 77 and has its outer perimeter fixedly secured to a cylindrical walled support member 78. Preferably the cylindrical wall support member 78 and disk 76 are both comprised of a ceramic material such as Alumina. Alternatively, the disk 76 and cylindrical support member 78 may both be made of a single piece of suitable material that is manufactured, formed or machined using appropriate methods for the specific material.

As in the embodiment described above, the support member 78 is electrically and/or thermally insulated and/or isolated from the stem 77. Permanent magnets 82 are securely attached on an outer surface 80 of the support member 78. Preferably the magnets 82 are comprised of samarium-cobalt. Other suitable materials having the desired magnetic properties may be used for the magnets such as neodymium-iron-boron as well as others. The material selection, dimensions and physical configuration of the disk 76 and cylindrical support member 78 are selected to (i) prevent heat related damage to the permanent magnets and (ii) adequately insulate the rotary drive components located within the evacuated envelope from the high anode voltage.

A sensor magnet 84 is securely placed on the support member 78 for commutation purposes. A magnetic pick up 86, for generating commutation signals, is located outside of the envelope 26. The pick up 86 is suitably connected to a motor controller 88. The motor controller 88 is controllably connected to a motor power supply 90. The motor controller 88 provides control signals to the power supply 89 to appropriately energize the stator 75 in response to commutation signals from the sensor 84. The described arrangement above, shown in FIG. 2*b*, is a schematic representation of a permanent magnet, electrically commutated motor that is suitable for this embodiment of the present invention. One skilled in the art will appreciate that the number of magnetic poles, sensor magnets and pick ups may be varied according to the desired, operation, motor characteristics and motor control characteristics. In operation, the power supply 90 provides an appropriately commutated drive field via the stator windings to rotate the anode disk 30 at the desired acceleration to the desired angular velocity.

Referring now to FIG. 3, yet another embodiment of the present invention is shown. An alternative rotor drive apparatus 100 comprises an external drive portion 102 located outside of the vacuum envelope 26 of the x-ray tube 20. A magnetic rotor assembly 104 within the x-ray tube vacuum envelope 26 operatively interacts with the external drive portion 102.

The external drive portion 102 includes a sealed envelope 106, a rotary drive 108 and an annular drive disk 114. The envelope 106 is comprised of glass, or another suitable material, and is placed adjacent to the x-ray tube 20 such that the annular drive disk 114 is in operative relationship with the magnetic rotor assembly 104, as described below. The envelope 106 encloses the aforementioned rotating drive components in order to prevent fluid resistance to rotation of the drive disk 114. The outer surface of the envelope 106 may contact the x-ray tube 20 or may be another sealed chamber of an x-ray tube having a common wall section between the vacuum in the x-ray tube and the external drive portion of the envelope. The envelope 106 need not be a vacuum envelope.

The rotary drive 108 is securely positioned within the envelope 106. In this embodiment, the rotary drive 108 is an induction motor. A drive shaft 112 extends from the rotary drive 108. Supports 110 retain the rotary drive 108 to position the drive shaft 112 for rotation generally along the axis A—A.

The annular drive disk 114 is secured at its center to the drive shaft 112. A plurality of permanent magnets 116 are attached on a planar surface 118 in an appropriate manner, number and configuration to magnetically couple with the magnetic rotor assembly 104 as described below. The disk 114 is comprised of any suitably rigid material to support the magnets in the desired positions without substantially affecting the magnetic properties and fields of the magnets such that the operability of the motor is deleteriously affected. The surface 118 of the disk 114 faces the magnetic rotor assembly 104 in the adjacent x-ray tube 20. The rotary drive 108 is electrically connected via conductors extending through the envelope 106 to an appropriate source of electrical energy. When energized, the rotary drive 108 rotates the drive shaft 112 as desired, and thus the drive disk 114.

The magnetic rotor assembly 104, located within the vacuum envelope 26 of the x-ray tube, includes an annular ceramic rotor disk 120. The rotor disk 120 is comprised of an electrically and thermally insulating material, such as a ceramic material described above, to electrically and/or thermally isolate and/or insulate the high voltage and temperature present on the anode stem 32 from the drive components 102. The center of the rotor disk 120 is securely attached to a drive end 122 of the stem 32. A plurality of permanent magnets 124, similar to those described above, are attached in an appropriate manner, number and configuration to the rotor disk 120. Specifically, the magnets 124 are secured on a planar surface 126 facing the drive disk 114 in the magnetic drive portion 102. The number, configuration and arrangement of the magnets 116, 124 on the disks 114, 120 are selected to obtain magnetic coupling between them such that rotation of the drive disk 114 results in the desired rotation of the rotor disk 120.

The dimensions of the disk 120 are selected to reduce electrical arcing due to the large potential difference between the stem 32 and the external drive components. In addition, the configuration of the disk is selected such that the permanent magnets are suitably thermally insulated from heat in the stem 32 to prevent thermal damage to the structure and magnetic properties of the magnets 124. These dimensions and methods of attachment will vary depending upon specific x-ray tube operating characteristics such as, for example, the anode voltage, anode rotation requirements and heat generated during operation etc.

In another embodiment of the present invention, the drive 108 may be a fluid drive means driven by a fluid pump (not shown) external to the housing 28 and appropriately connected with fluid supply and return hoses, ports, reservoirs, valves and control apparatus to rotate the drive shaft 112 and drive disk 114 at the desired acceleration and angular velocity to rotate the anode as desired for tube operation. In addition to the fluid drive embodiment, other AC motor configurations as well as a DC motor may be used for the rotary drive 108.

Turning now to FIG. 4, another embodiment of the rotary drive apparatus of the present invention is shown. A pancake wound stator 138 is secured in the housing 28 with supports 68 such that it is operatively adjacent to the magnetic rotor assembly 104. The pancake stator 138 is positioned adjacent to the envelope to magnetically couple the rotating magnetic fields of the pancake stator with the magnetic rotor assembly 104 when the stator is energized.

The magnetic rotor assembly 104 in the vacuum envelope 26 includes an annular ceramic rotor disk 120. The center of the rotor disk 120 is attached to a drive end 122 of the stem 32. A plurality of permanent magnets 124, similar to those described above, are attached in an appropriate manner, number and configuration to the rotor disk 120 on the planar surface 126. The number and configuration of the magnets 124 is selected to obtain adequate magnetic coupling with the rotating magnetic field of the pancake stator 138 thereby causing the desired rotation of the rotor disk 120. As in the embodiments previously described, the anode voltage is insulated such that the stator 138 may be more closely spaced with respect to the rotor assembly 104 to improve magnetic coupling and motor efficiency A sensor magnet 130 is placed on the rotor disk 120 for commutation purposes. A magnetic pick up 132 for generating commutation signals is placed outside of the envelope 26. The pick up 132 is suitably connected to a motor controller 134 which is controllably connected to a motor power supply 136. The motor controller 134 provides control signals to the power supply 136 to appropriately energize the fields of the pancake stator 138 in response to commutation signals from the sensor 132.

The described arrangement above, shown in FIG. 4, is a schematic representation of a permanent magnet, electrically commutated motor having a pancake stator that is suitable for this embodiment of the present invention. One skilled in the art will appreciate that the number of magnets, magnetic poles, stator windings and arrangement, sensor magnets and pick ups may be varied according to the desired operation, motor characteristics and motor control characteristics. In operation of this embodiment, the pancake stator 138 is energized by the power supply 136 in response to control signals provided by the motor controller 134. The power supply 136 provides an appropriately commutated rotary drive field via the stator windings to rotate the anode disk 30 at the desired acceleration to the desired angular velocity.

While a particular feature of the invention may have been described above with respect to only one of the illustrated embodiments, such features may be combined with one or more other features of other embodiments, as may be desired and advantageous for any given particular application.

From the above description of the invention, those skilled in the art will perceive improvements, changes and modification. Such improvements, changes and modification within the skill of the art are intended to be covered by the appended claims. For example, in the embodiment described with respect to FIG. 4, a copper disk can be securely attached to the surface 126 of the rotor disk 120. As the magnetic fields produced in the pancake wound stator 138 rotate, eddy currents are created in the copper disk attached to the rotor disk 120. These eddy currents create magnetic fields that magnetically couple to the magnetic fields from the stator 138, thereby causing the rotor to rotate as the stator fields rotate. In addition, the principles of the invention are not limited to the specific bearing assembly disclosed herein. Any of a number of conventional x-ray tube bearing assembly designs using suitable materials having sufficient electrical and/or thermal insulation to insulate the rotor from anode potential/heating can be utilized to practice the invention.

What is claimed is:

1. An x-ray tube comprising:

an evacuated envelope;

a cathode mounted in the envelope;

an anode rotatably mounted in the evacuated envelope;

a rotor for rotatably driving the anode, the rotor electrically insulated from the anode;

an electrically conductive stem attached between the anode and the rotor, the electrically conductive stem providing an electrical path to provide electrical operating power to the anode; and a rotor support attached to the rotor and the stem, the rotor support electrically insulating the rotor from the stem.

2. The x-ray tube of claim 1 wherein the stem is rotatably supported in the evacuated envelop by at least one bearing, the bearing having an outer bearing race member, the envelope of the x-ray tube having a cylindrical wall portion and the outer bearing race member of the bearing is received along an inner surface of the cylindrical wall portion of the envelope.

3. The x-ray tube of claim 1 wherein the electrically insulating member is a ceramic material.

4. The x-ray tube of claim 3 wherein the ceramic material is Alumina.

5. The apparatus of claim 1 wherein the rotor is a disk configuration.

6. The x-ray tube of claim 1 wherein the rotor includes permanent magnets.

7. The x-ray tube of claims 6 further including a drive member external to the tube, the drive member including means for providing a magnetic field coupled to the rotor.

8. The x-ray tube of claim 7 wherein the drive member includes a fluid drive.

9. The x-ray tube of claim 1 wherein the anode is rotatably supported by a stem attached to the anode; and an electrically insulating member connected to the stem and the rotor whereby the rotor is electrically insulated from the stem.

10. An apparatus for rotating an anode in an x-ray tube, the apparatus comprising:

a bearing assembly supported within the x-ray tube;

a stem attached to the anode, the stem rotatably supported in the bearing assembly;

a member comprised of an electrically insulating material and having a first surface and a second surface spaced apart from each other, the first surface attached to the stem; and a rotor located within the x-ray tube, the rotor attached to the second surface of the member whereby the rotor is electrically insulated from the anode.

11. The apparatus for rotating an anode in an x-ray tube of claim 10 wherein the member is a thermal insulator.

12. The apparatus for rotating an anode in an x-ray tube of claim 10 wherein the member is a ceramic material.

13. The apparatus for rotating an anode in an x-ray tube of claim 12 wherein the ceramic is alumina.

14. The apparatus for rotating an anode in an x-ray tube of claim 10 wherein the rotor s a disk configuration.

15. The apparatus for rotating an anode in an x-ray tube of claim 10 wherein the rotor includes permanent magnets.

16. The apparatus for rotating an anode in an x-ray tube of claim 15 further including a drive member external to the tube, the drive member including means for providing a magnetic field coupled to the rotor.

17. The apparatus for rotating an anode in an x-ray tube of claim 16 wherein the drive member includes a fluid drive.

18. The apparatus for rotating an anode in an x-ray tube of claim 16 wherein the drive member is a stator.

19. The apparatus for rotating an anode in an x-ray tube of claim 18 wherein the stator is a pancake configuration.

20. An apparatus-for rotating an anode in an x-ray tube, the apparatus comprising:

an electrically conductive stem attached to the anode;

means for rotatably supporting the stem in the x-ray tube;

means for supplying an electrically conductive path through the stem to the anode;

a rotor adapted to couple a drive force to rotate the anode; and means for electrically insulating the anode from the rotor.

21. The apparatus for rotating an anode in an x-ray tube of claim 20 wherein the means for coupling a drive force adapted to rotate the anode includes a rotor from an induction motor.

22. The apparatus for rotating an anode in an x-ray tube of claim 20 including an external drive member wherein the means for coupling a drive force adapted to rotate the anode includes permanent magnets.

23. The apparatus for rotating an anode in an x-ray tube of claim 20 wherein the means for rotatably supporting the stem includes at least one bearing, the bearing having an outer bearing race member, the evacuated envelope of the x-ray tube includes a cylindrical wall portion, and the outer bearing race member of the bearing is received along an inner surface of the cylindrical wall portion.

24. An x-ray tube comprising:

an evacuated- envelope;

a cathode mounted in the envelope;

an anode rotatably mounted in the evacuated envelope;

a rotor for rotatably driving the anode, the rotor electrically insulated from the anode; and a stem attacked to the anode, the stem rotatably supported in the evacuated envelop by at least one bearing, the bearing having an outer bearing race member, the envelope of the x-ray tube having a cylindrical wall portion and the outer bearing race member of the bearing is received along an inner surface of the cylindrical wall portion of the envelope.

25. An apparatus for rotating an anode in an x-ray tube, the apparatus comprising:

a stem attached to the anode;

means for rotatably supporting the stem in the x-ray tube wherein the means for rotatably supporting the stem includes at least one bearing, the bearing having an outer bearing race member, the evacuated envelope of the x-ray tube includes a cylindrical wall portion, and the outer bearing race member of the bearing is received along an inner surface of the cylindrical wall portion;

means for coupling a drive force adapted to rotate the anode; and means for electrically insulating the anode from the means for coupling the drive force.

* * * * *